US012516579B2

(12) United States Patent
Steele

(10) Patent No.: US 12,516,579 B2
(45) Date of Patent: Jan. 6, 2026

(54) ANCHOR WITH MULTIPLE ARMS FOR MINIMAL ROTATION OF LATCH DURING GUIDED ORIENTATION

(71) Applicant: Halliburton Energy Services, Inc., Houston, TX (US)

(72) Inventor: David J. Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 99 days.

(21) Appl. No.: 18/488,533

(22) Filed: Oct. 17, 2023

(65) Prior Publication Data

US 2025/0122771 A1 Apr. 17, 2025

(51) Int. Cl.
*E21B 23/01* (2006.01)
*E21B 17/02* (2006.01)

(52) U.S. Cl.
CPC ..... *E21B 23/01* (2013.01); *E21B 17/021* (2013.01)

(58) Field of Classification Search
CPC ..... E21B 23/01; E21B 17/021; E21B 23/02
See application file for complete search history.

(56) References Cited

U.S. PATENT DOCUMENTS 3,799,259 A 3/1974 Dinning
6,298,915 B1 10/2001 George
6,419,012 B1 7/2002 George et al.
6,591,905 B2 7/2003 Coon
7,240,738 B2 7/2007 Pendleton
8,256,518 B2 * 9/2012 Guven ..... E21B 23/006 166/373
8,376,054 B2 2/2013 Lang et al.
8,590,608 B2 11/2013 Linn et al.
8,678,097 B1 3/2014 Telfer et al.
9,140,081 B2 9/2015 Telfer et al.
2002/0023757 A1 2/2002 George et al.
2002/0079102 A1 6/2002 Dewey et al.
2018/0258701 A1 9/2018 Saurer

FOREIGN PATENT DOCUMENTS

CN 212927829 U 4/2021

OTHER PUBLICATIONS

Halliburton. First 9 5/8-in. ReFlexRite® System Installation Using XtremeGrip® MLT System in Norway. Halliburton, 2020. H013445 Jan. 2020. PDF file. 2 pages.
Halliburton. "FlexRite® Multilateral Completion System." Company Website, https://www.halliburton.com/en/products/flexrite-multibranch-inflow-control-multilateral-system. Accessed Oct. 23, 2023.
Halliburton. Workstring Orientation Tool Reduces Cost and HSE Risk of More Than 130 Multilateral Operational Runs. Halliburton, 2023. H013719 Aug. 2023. PDF file. 2 pages.
(Continued)

*Primary Examiner* — Tara Schimpf
(74) *Attorney, Agent, or Firm* — Scott Richardson; C. Tumey Law Group PLLC

(57) ABSTRACT

A system that includes an anchor that includes a first slot and a second slot, and a latch that includes a first key and a second key, where while the latch undergoes latch translation, the first key and the second key are adapted to translate into the first slot and the second slot, respectively.

20 Claims, 11 Drawing Sheets

(56) References Cited

OTHER PUBLICATIONS

Halliburton. ReFlexRite® Milled Exit Multilateral Completion System. Halliburton, 2016. H05737 Jul. 2016. PDF file. 2 pages.
Halliburton. "IsoRite® Multilateral Completion System." Company Website, https://www.halliburton.com/en/products/isorite-multilateral-completion-system. Accessed Oct. 23, 2023.
Halliburton. "FloRite Multilateral Completion System." Company Website, https://www.halliburton.com/en/products/florite-multilateral-completion-system. Accessed Oct. 23, 2023.
Halliburton. IsoRite® Isolated Multilateral Completion Systems. Halliburton, 2018. H02578 Nov. 2018. PDF file. 3 pages.
Halliburton. VersaFlex® XSL Expandable Liner Hanger System Provides 100% Reliable Solution to Challenging Large-Scale Project. Halliburton, 2023. H014029 Jul. 2023. PDF file. 2 pages.
Prosecution History 8678097. Response to Office Action for U.S. Appl. No. 13/945,808 dated Nov. 7, 2013. PDF file. 8 pages.
Prosecution History 8590608. Response to Office Action for U.S. Appl. No. 13/162,072 dated Mar. 14, 2013. PDF file. 9 pages.
Schlumberger. RapidX TAML 5 High-Strength, Hydraulic-Sealed Multilateral Junction. Schlumberger, 2021. 21-WPS-960973. PDF file. 2 pages.
Schlumberger. SLIC Selective Lateral Intervention Completion System. Schlumberger, 2019. 19-CO-661132. PDF file. 2 pages.
CTNF Non-Final Office Action with Rejection for U.S. Appl. No. 13/945,808 dated Nov. 7, 2013. PDF file. 8 pages.
CTNF Non-Final Office Action with Rejection for U.S. Appl. No. 13/162,072 dated Mar. 14, 2013. PDF file. 10 pages.
Prosecution History 9140081. Response to Office Action for U.S. Appl. No. 14/170,583 dated Feb. 24, 2015. PDF file. 7 pages.
CTNF Non-Final Office Action with Rejection for U.S. Appl. No. 14/170,583 dated Feb. 24, 2015. PDF file. 5 pages.
U.S. Appl. No. 63/521,826, filed Jun. 19, 2023.
International Search Report and Written Opinion for International Patent Application No. PCT/US2023/079100 dated Jul. 11, 2024. PDF file. 7 pages.

* cited by examiner

ANCHOR WITH MULTIPLE ARMS FOR MINIMAL ROTATION OF LATCH DURING GUIDED ORIENTATION

BACKGROUND

The oil and gas industry may use boreholes as fluid conduits to access subterranean deposits of various fluids and minerals which may include hydrocarbons. A drilling operation may be utilized to construct the fluid conduits which are capable of producing hydrocarbons disposed in subterranean formations. Boreholes may be incrementally constructed as tapered sections, which sequentially extend into a subterranean formation.

The widest diameter sections may be located near the surface of the earth while the narrowest diameter sections may be disposed at the toe of the well. For example, starting at the surface of the earth, borehole sections may include any combination of a conductor borehole, one or more surface boreholes, one or more intermediate boreholes, a pilot borehole, and/or a production borehole. The diameter of the foregoing borehole sections may sequentially decrease in diameter from the conductor borehole to the production borehole.

One or more tools and/or machines may be statically fixed in a borehole. Additional tools may be used to fix the tools and/or machines into the borehole using one or more procedures needed for those tools.

BRIEF DESCRIPTION OF DRAWINGS

These drawings illustrate certain aspects of some examples of the present disclosure and should not be used to limit the disclosure.

DETAILED DESCRIPTION

Overview and Advantages

Figure 1:
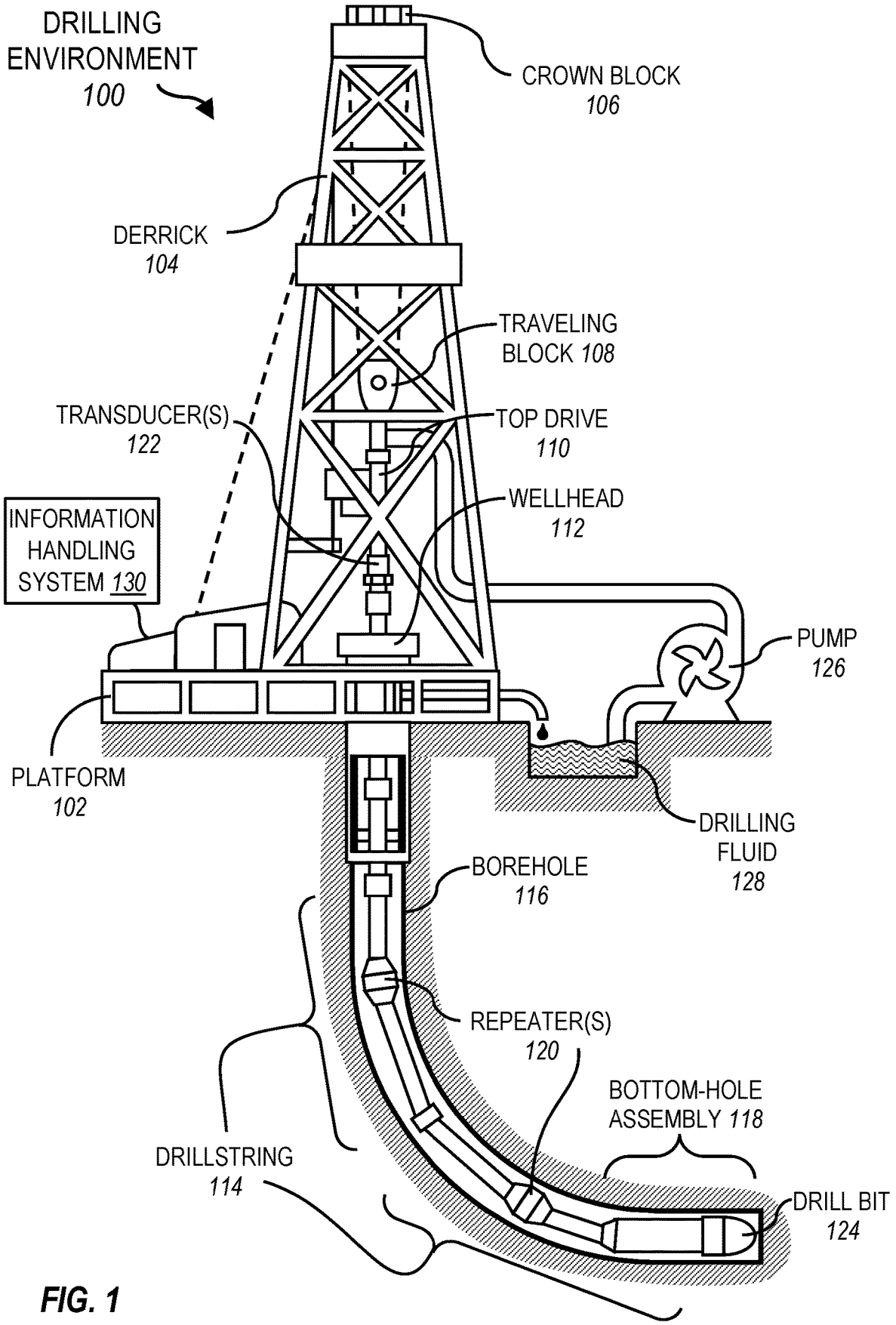
FIG. 1 is a diagram of an example drilling environment.

In general, this application discloses one or more embodiments of methods and systems for providing a latch and anchor mechanism (in a borehole) which requires minimal rotation of the latch to engage the anchor.

Generally, for latch and anchor mechanisms, a latch and anchor may be aligned using a key and slot system. That is, a key may protrude on a latch while a slot may provide a gap on the anchor. For the latch and anchor to properly interlock, the key (of the latch) must align with the slot (of the anchor) before the two components may fully engage each other. In borehole environment, the alignment is dependent upon the rotation (e.g., angle) and geometry of the latch and anchor (e.g., each component must be within some threshold similar angle, less than 1° apart, less than 0.5° apart, etc.)

In conventional latch and anchor mechanisms, a single key may be provided on the latch while a single slot may be provided on the anchor. While such a system ensures alignment at a single angle, a latch may have to rotate ±180° (or nearly 360°, depending on the configuration) for the key and slot to align. To cause this rotation, one or more guides may be placed at the leading edge of the anchor to rotate the latch before engaging the anchor. Consequently, rotation of the latch may cause torsional stress to be statically loaded on the latch (and/or any tools additionally attached to the latch). Such stress may be undesirable as the latch (and/or any tools affixed thereto) (i) may not be designed to accept such stresses, (ii) wear out more quickly, (iii) require additional design and material costs to produce tools that can accept such stresses. Further, in system where there is only a single key (or a single initial point of contact between the latch and anchor) there is a possibility that the latch and anchor may improperly engage (e.g., a key may slide into an internal diameter of the anchor at an undesirable location).

As disclosed in one or more embodiments herein, a latch and anchor may include multiple keys and slots to provide multiple proper angles of engagement. As a non-limiting example, in an embodiment with three keys and three slots, a latch would only need to rotate ±60° (or nearly 120°, depending on the configuration). Thus, only one-third of the rotation may be required, thereby reducing the torsional stresses in the latch (and/or any tools attached thereto). Further, in any embodiment, as multiple keys may contact the anchor simultaneously, the risk of improper engagement is dramatically reduced (if not eliminated entirely).

Further, embodiments of the systems disclosed herein may be used with existing workstring orienting tools (WOTs). In a conventional environment, a WOT may be used to orient a workstring and/or confirm the orientation of a workstring. A WOT may be used prior to engagement (of the key with the anchor) to provide initial alignment (especially in circumstances where each key must align with a specific slot). Further, once inserted into the anchor, the WOT may be used to confirm the correct orientation of the workstring, as inserted.

The systems disclosed in one or more embodiments herein provide the ability and means to orient, align, and couple a downhole device from a remote distance and under harsh conditions. Non-limiting examples of harsh conditions include a borehole with solids-contaminated fluids (e.g., drilling fluids and/or completion fluids), extreme pressures (e.g., greater than 10,000 pounds-per-square-inch (PSI) pressure differential), and extreme temperatures (e.g., −20° F. (−28.89° C.) to over 300° F. (148.89° C.)). As such, the system may be suitable for use in many types of environments, including low-gravity (e.g., satellites, spacecrafts), aeronautics (e.g., aircraft), on-ground (e.g., swamps and marshes), below ground (e.g., mines, caves), ocean surface or subsea, and subterranean environments such as mineral extraction, storage wells (e.g., carbon sequestration, carbon capture and storage (CCS)), and other energy recovery activities (e.g., geothermal, steam).

FIG. 1

FIG. 1 is a diagram of an example drilling environment. Drilling environment 100 may include platform 102 that supports derrick 104 having a traveling block 108 for raising and lowering top drive 110 and drillstring 114. Top drive 110 supports and rotates drillstring 114 as it is lowered through wellhead 112. In turn, drill bit 124, located at the end of drillstring 114, may create borehole 116. Each of these components is described below.

Platform 102 is a structure which may be used to support one or more other components of drilling environment 100 (e.g., derrick 104). Platform 102 may be designed and constructed from suitable materials (e.g., concrete) which are able to withstand the forces applied by other components (e.g., the weight and counterforces experienced by derrick 104). In any embodiment, platform 102 may be constructed to provide a uniform surface for drilling operations in drilling environment 100.

Derrick 104 is a structure which may support, contain, and/or otherwise facilitate the operation of one or more pieces of the drilling equipment. In any embodiment, derrick 104 may provide support for crown block 106, traveling block 108, and/or any part connected to (and including) drillstring 114. Derrick 104 may be constructed from any suitable materials (e.g., steel) to provide the strength necessary to support those components.

Crown block 106 is one or more simple machine(s) which may be rigidly affixed to derrick 104 and include a set of pulleys (e.g., a "block"), threaded (e.g., "reeved") with a drilling line (e.g., a steel cable), to provide mechanical advantage. Crown block 106 may be disposed vertically above traveling block 108, where traveling block 108 is threaded with the same drilling line.

Traveling block 108 is one or more simple machine(s) which may be movably affixed to derrick 104 and include a set of pulleys, threaded with a drilling line, to provide mechanical advantage. Traveling block 108 may be disposed vertically below crown block 106, where crown block 106 is threaded with the same drilling line. In any embodiment, traveling block 108 may be mechanically coupled to drillstring 114 (e.g., via top drive 110) and allow for drillstring 114 (and/or any component thereof) to be lifted from (and out of) borehole 116. Both crown block 106 and traveling block 108 may use a series of parallel pulleys (e.g., in a "block and tackle" arrangement) to achieve significant mechanical advantage, allowing for the drillstring to handle greater loads (compared to a configuration that uses non-parallel tension). Traveling block 108 may move vertically (e.g., up, down) within derrick 104 via the extension and retraction of the drilling line.

Top drive 110 is a machine which may be configured to rotate drillstring 114. Top drive 110 may be affixed to traveling block 108 and configured to move vertically within derrick 104 (e.g., along with traveling block 108). In any embodiment, the rotation of drillstring 114 (caused by top drive 110) may allow for drillstring 114 to carve borehole 116. Top drive 110 may use one or more motor(s) and gearing mechanism(s) to cause rotations of drillstring 114. In any embodiment, a rotatory table (not shown) and a "Kelly" drive (not shown) may be used in addition to, or instead of, top drive 110.

Wellhead 112 is a machine which may include one or more pipes, caps, and/or valves to provide pressure control for contents within borehole 116 (e.g., when fluidly connected to a well (not shown)). In any embodiment, during drilling, wellhead 112 may be equipped with a blowout preventer (not shown) to prevent the flow of higher-pressure fluids (in borehole 116) from escaping to the surface in an uncontrolled manner. Wellhead 112 may be equipped with other ports and/or sensors to monitor pressures within borehole 116 and/or otherwise facilitate drilling operations.

Drillstring 114 is a machine which may be used to carve borehole 116 and/or gather data from borehole 116 and the surrounding geology. Drillstring 114 may include one or more drillpipe(s), one or more repeater(s) 120, and bottom-hole assembly 118. Drillstring 114 may rotate (e.g., via top drive 110) to form and deepen borehole 116 (e.g., via drill bit 124) and/or via one or more motor(s) attached to drillstring 114.

Borehole 116 is a hole in the ground which may be formed by drillstring 114 (and one or more components thereof). Borehole 116 may be partially or fully lined with casing to protect the surrounding ground from the contents of borehole 116, and conversely, to protect borehole 116 from the surrounding ground.

Bottom-hole assembly 118 is a machine which may be equipped with one or more tools for creating, providing structure, and maintaining borehole 116, as well as one or more tools for measuring the surrounding environment (e.g., measurement while drilling (MWD), logging while drilling (LWD)). In any embodiment, bottom-hole assembly 118 may be disposed at (or near) the end of drillstring 114 (e.g., in the most "downhole" portion of borehole 116).

Non-limiting examples of tools that may be included in bottom-hole assembly 118 include a drill bit (e.g., drill bit 124), casing tools (e.g., a shifting tool), a plugging tool, a mud motor, a drill collar (thick-walled steel pipes that provide weight and rigidity to aid the drilling process), actuators (and pistons attached thereto), a steering system, and any measurement tool (e.g., sensors, probes, particle generators, etc.).

Further, bottom-hole assembly 118 may include a telemetry sub to maintain a communications link with the surface (e.g., with information handling system 130). Such telemetry communications may be used for (i) transferring tool measurement data from bottom-hole assembly 118 to surface receivers, and/or (ii) receiving commands (from the surface) to bottom-hole assembly 118 (e.g., for use of one or more tool(s) in bottom-hole assembly 118).

Non-limiting examples of techniques for transferring tool measurement data (to the surface) include mud pulse telemetry and through-wall acoustic signaling. For through-wall acoustic signaling, one or more repeater(s) 120 may detect, amplify, and re-transmit signals from bottom-hole assembly 118 to the surface (e.g., to information handling system 130), and conversely, from the surface (e.g., from information handling system 130) to bottom-hole assembly 118.

Repeater 120 is a device which may be used to receive and send signals from one component of drilling environment 100 to another component of drilling environment 100. As a non-limiting example, repeater 120 may be used to receive a signal from a tool on bottom-hole assembly 118 and send that signal to information handling system 130. Two or more repeaters 120 may be used together, in series, such that a signal to/from bottom-hole assembly 118 may be relayed through two or more repeaters 120 before reaching its destination.

Transducer 122 is a device which may be configured to convert non-digital data (e.g., vibrations, other analog data) into a digital form suitable for information handling system 130. As a non-limiting example, one or more transducer(s) 122 may convert signals between mechanical and electrical forms, enabling information handling system 130 to receive the signals from a telemetry sub, on bottom-hole assembly 118, and conversely, transmit a downlink signal to the telemetry sub on bottom-hole assembly 118. In any embodiment, transducer 122 may be located at the surface and/or any part of drillstring 114 (e.g., as part of bottom-hole assembly 118).

Drill bit 124 is a machine which may be used to cut through, scrape, and/or crush (i.e., break apart) materials in the ground (e.g., rocks, dirt, clay, etc.). Drill bit 124 may be disposed at the frontmost point of drillstring 114 and bottom-hole assembly 118. In any embodiment, drill bit 124 may include one or more cutting edges (e.g., hardened metal points, surfaces, blades, protrusions, etc.) to form a geometry which aids in breaking ground materials loose and further crushing that material into smaller sizes. In any embodiment, drill bit 124 may be rotated and forced into (i.e., pushed against) the ground material to cause the cutting, scraping, and crushing action. The rotations of drill bit 124 may be caused by top drive 110 and/or one or more motor(s) located on drillstring 114 (e.g., on bottom-hole assembly 118).

Pump 126 is a machine that may be used to circulate drilling fluid 128 from a reservoir, through a feed pipe, to derrick 104, to the interior of drillstring 114, out through drill bit 124 (through orifices, not shown), back upward through borehole 116 (around drillstring 114), and back into the reservoir. In any embodiment, any appropriate pump 126 may be used (e.g., centrifugal, gear, etc.) which is powered by any suitable means (e.g., electricity, combustible fuel, etc.).

Drilling fluid 128 is a liquid which may be pumped through drillstring 114 and borehole 116 to collect drill cuttings, debris, and/or other ground material from the end of borehole 116 (e.g., the volume most recently hollowed by drill bit 124). Further, drilling fluid 128 may provide conductive cooling to drill bit 124 (and/or bottom-hole assembly 118). In any embodiment, drilling fluid 128 may be circulated via pump 126 and filtered to remove unwanted debris.

Information handling system 130 is a computing system which may be operatively connected to drillstring 114 (and/or other various components of the drilling environment). In any embodiment, information handling system 130 may utilize any suitable form of wired and/or wireless communication to send and/or receive data to and/or from other components of drilling environment 100. In any embodiment, information handling system 130 may receive a digital telemetry signal, demodulate the signal, display data (e.g., via a visual output device), and/or store the data. In any embodiment, information handling system 130 may send a signal (with data) to one or more components of drilling environment 100 (e.g., to control one or more tools on bottom-hole assembly 118).

Information handling system 130 is a hardware computing device which may be utilized to perform various steps, methods, and techniques disclosed herein (e.g., via the execution of software). In any embodiment, information handling system 130 may include one or more processor(s), cache, memory, storage, and/or one or more peripheral device(s). Any two or more of these components may be operatively connected via a system bus that provides a means for transferring data between those components.

FIG. 2

Figure 2:
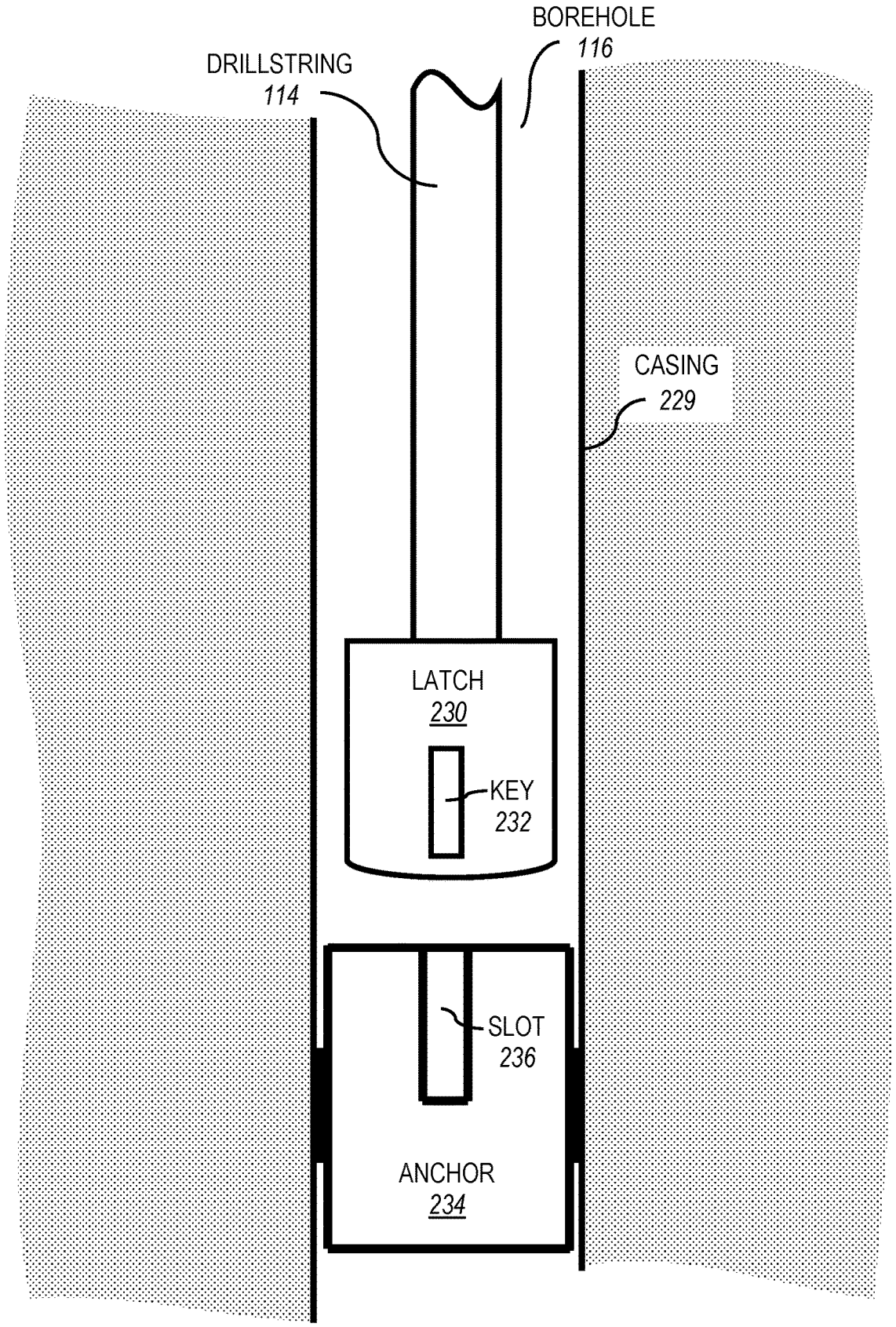
FIG. 2 is a diagram of an example borehole with a latch and anchor.

FIG. 2 is a diagram of an example borehole with a latch and anchor.

Casing 229 is a structure which is rigidly fixed inside borehole 116. In any embodiment, casing 229 may be constructed from steel pipe(s) cemented into borehole 116. The interior of casing 229 may form a volume in which drillstring 114 may translate and rotate to continue forming borehole 116 (e.g., drilling). Casing 229 may provide structure to separate and prevent interaction between the contents of borehole 116 and the ground around borehole 116. Further, in any embodiment, casing 229 may include one or more means for rigidly affixing to one or more other structural components (e.g., a socket and/or groove in casing 229 where anchor 234 may connect).

Latch 230 is a machine which is configured to interlock with anchor 234. Latch 230 may include one or more key(s) 232 to enable desired alignment with anchor 234. Latch 230 may be connected to the end of drillstring 114 (or any wireline or coiled tubing) to descend borehole 116, align, contact, and/or interlock with anchor 234. In any embodiment, one or more tools may be affixed to latch 230 (e.g., uphole on drillstring 114, wireline, or coiled tube) and may be placed in a desired position (depth and rotation) using latch 230 and anchor 234. In any embodiment, latch 230 and anchor 234 may be constructed such that the outer diameter of latch 230 (excluding any key 232) is smaller than the internal diameter of anchor 234. Accordingly, when concentrically aligned, latch 230 may (at least) partially traverse the internal volume of anchor 234.

Key 232 is a component of latch 230 which may be used to align latch 230 at a desired angle with anchor 234. In any embodiment, key 232 may take the form of a protrusion extending radially outward from latch 230. Further, in any embodiment, key 232 may be geometrically shaped to engage with slot 236 of anchor 234. In any embodiment, the outer diameter formed by keys 232 may be larger than the internal diameter of anchor 234 and/or casing 229. In such instances, key(s) 232 may be spring loaded, hydraulically controlled, and/or otherwise constructed to allow for inward (and outward) linear motion (e.g., key depression 443). In any embodiment, key 232 may be made from a material that is softer than the material used to construct anchor 234. Accordingly, key 232 is more likely absorb wear-and-tear and/or other damage than anchor 234. It may be preferable for key 232 wear prior to (or instead of) anchor 234, as key 232 is more easily retrievable and replaceable than anchor 234. As a non-limiting example, key 232 may be constructed from aluminum whereas anchor 234 is constructed from steel.

Anchor 234 is a machine which is configured to interlock with latch 230. Anchor 234 may be rigidly fixed in borehole 116 at a desired location and be aligned at a desired angle.

Anchor 234 may be rigidly fixed to borehole 116 and/or casing 229 via any suitable means.

Slot 236 is a component of anchor 234 which is designed to accept key 232. Slot 236 may take the form of a cutout (e.g., a negative volume) on the exterior of anchor 234. Further, in any embodiment, slot 236 may be geometrically shaped to accept key 232. As a non-limiting example, a slot may be sized to be slightly larger than key 232 such that key 232 may fit into (e.g., interlock) with slot 236.

A person of ordinary skill in the art, provided the benefit of this detailed description, would appreciate that the key(s) and slot(s) may be swapped on the latch and anchor. That is, the latch may include one or more slot(s) that engage with one or more key(s) on the anchor. The embodiments shown herein are only examples of latch and anchor systems. A consistent configuration is used to aid understanding of the system and to avoid cluttering the specification with repeated use of alternative embodiments.

FIGS. 3A-C

Figure 3A:
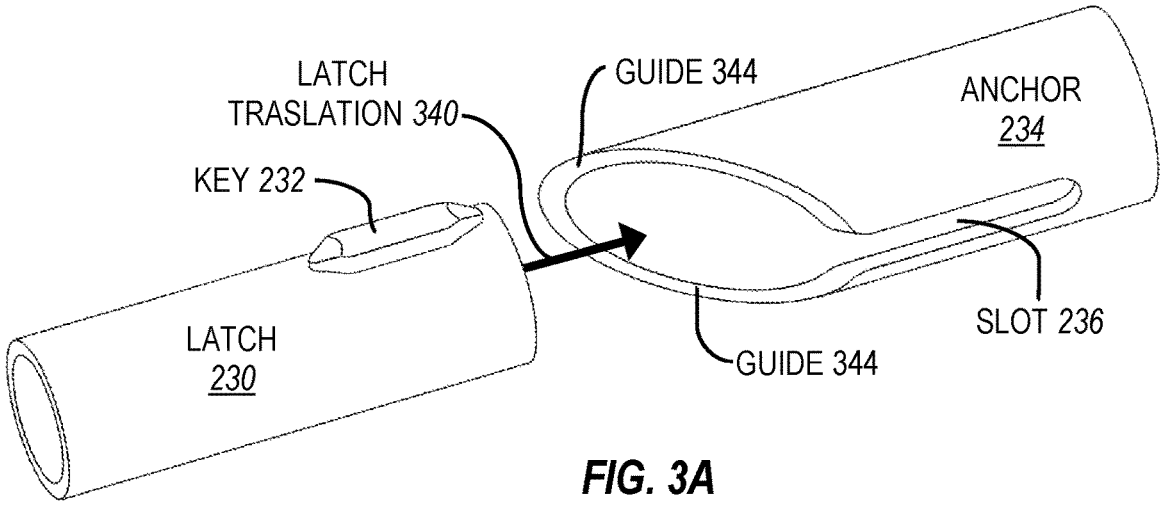
FIG. 3A is a diagram of an example latch and anchor, prior to contact.
Figure 3B:
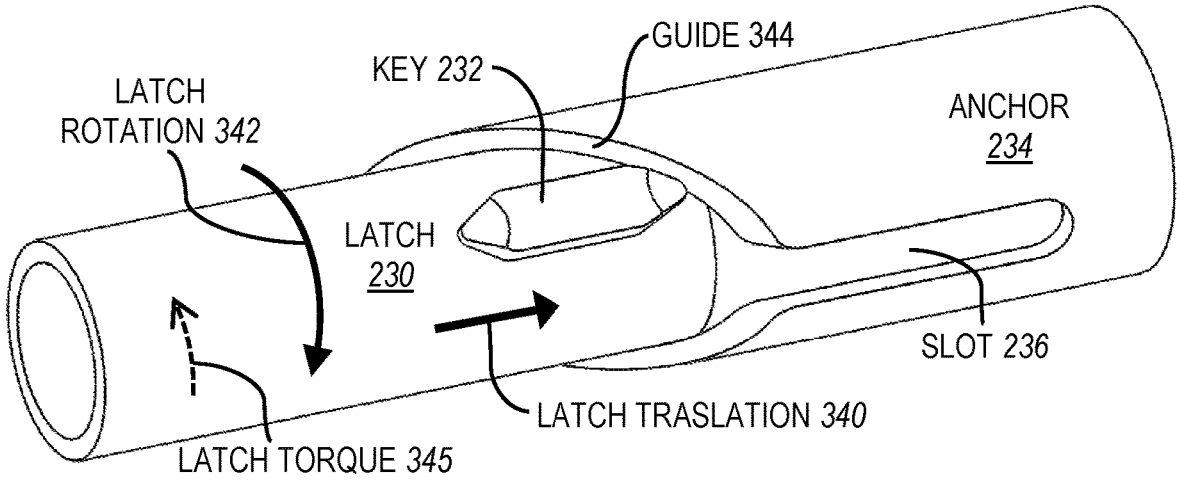
FIG. 3B is a diagram of an example latch and anchor when a key is in contact with a guide.
Figure 3C:
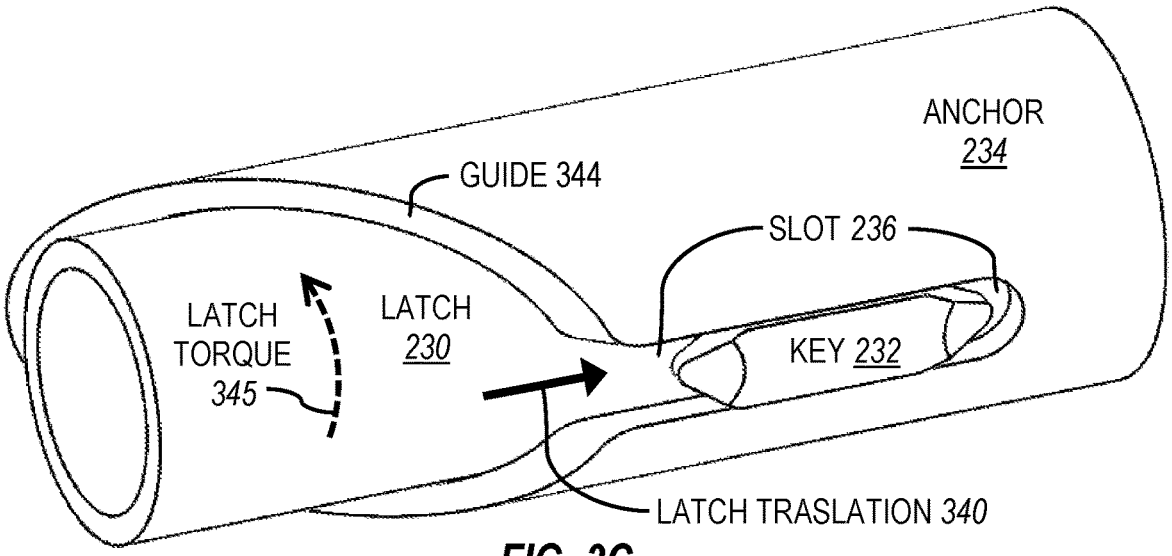
FIG. 3C is a diagram of an example latch and anchor interlocking.

FIG. 3A is a diagram of an example latch and anchor, prior to contact. FIG. 3B is a diagram of an example latch and anchor when a key is in contact with a guide. FIG. 3C is a diagram of an example latch and anchor interlocking. In the example of FIGS. 3A-C, a scenario is shown where latch 230 may experience large latch rotation 342 due to the single key 232 and single slot 236 design.

Latch translation 340 is the relative linear motion of latch 230 with respect to anchor 234. In any embodiment, anchor 234 is fixed in borehole 116 and latch 230 is caused to approach anchor via drillstring 114 (or a wireline or coiled tube). As can be seen in the example of FIG. 3A, key 232 will not directly align with slot 236 via latch translation 340. However, latch translation 340, in combination with key 232 and guide 344 may cause latch rotation 342. Latch translation 340 may stop when a downward-facing edge and/or face of key 232 engages an upward-facing edge and/or face of slot 236 (e.g., latch translation 340 is nearly complete in FIG. 3C as additional latch translation 340 would cause key 232 to impact the most downhole portion of slot 236). The upward edge and/or face of slot 236 may be referred to as the "bottom of the slot". In any embodiment, when key 232 engages the bottom of slot 236, the axial location of latch 340 may known (relative to anchor 234 and/or borehole 116).

Guide 344 is a component of anchor 234 which is used to rotate latch 230 (e.g., latch rotation 342). In any embodiment, guide 344 may be a sloped and/or helical cut (e.g., a ramp, with or without curvature) which causes latch rotation 342. That is, latch translation 340 forces key 232 to slide along guide 344 causing the whole of latch 230 to rotate. As such, the orientation of latch 230 may be controlled and set to a desired and/or known rotation. In any embodiment, guide 344 may be constructed with (and/or lined with) a material that is harder than that of anchor 234. As a non-limiting example, anchor 234 may be constructed from steel, and guide 344 may be lined with tungsten carbide to provide additional protection and wear resistance when engaging key(s) 232.

Latch rotation 342 is the relative angular motion of latch 230 with respect to anchor 234. In any embodiment, anchor 234 is fixed in borehole 116 and latch 230 is caused to rotate to align key 232 with slot 236 via latch rotation 342. As can be seen in the example of FIG. 3B, latch rotation 342 is caused by forcing key 232 to slide down the angled cutout of guide 344 (by latch translation 340) thereby making key 232 (and latch 230 generally) align with slot 236 (and anchor 234 generally).

Latch torque 345 is the torsional stress(es) experienced by latch 230, as caused by latch rotation 342. In any embodiment, the greater latch rotation 342 latch 230 undergoes, the greater latch torque 345 is experienced.

As shown in the example of FIGS. 3A-C, only single key 232 and a single slot 236 are provided. Accordingly, to align the single key 232 with the single slot 236, latch 230 must potentially undergo significant latch rotation 342. Specifically, in such a system, latch rotation 342 may be up to ±180° (e.g., if key 232 is 180° offset from slot 236). Consequently, such a large latch rotation 342 causes a correspondingly large (and undesirable) latch torque 345 on latch 230.

FIGS. 4A-C

Figure 4A:
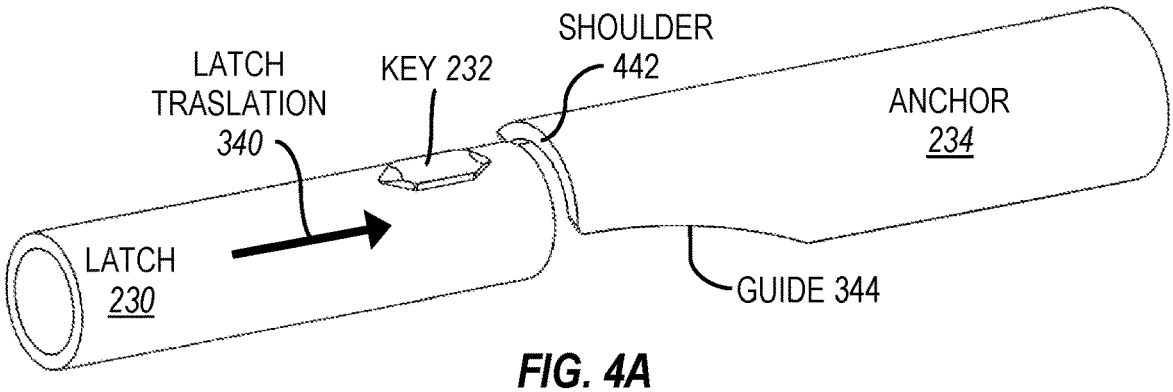
FIG. 4A is a diagram of a latch and anchor when a key is moving towards a shoulder.
Figure 4B:
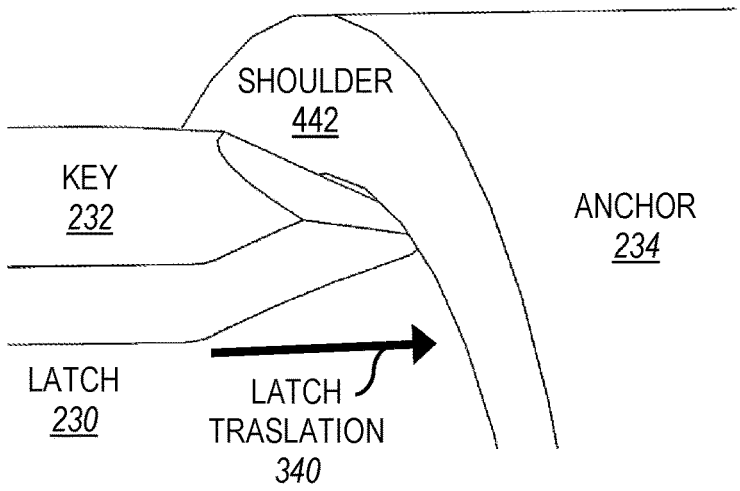
FIG. 4B is a diagram of a latch and anchor improperly engaging.
Figure 4C:
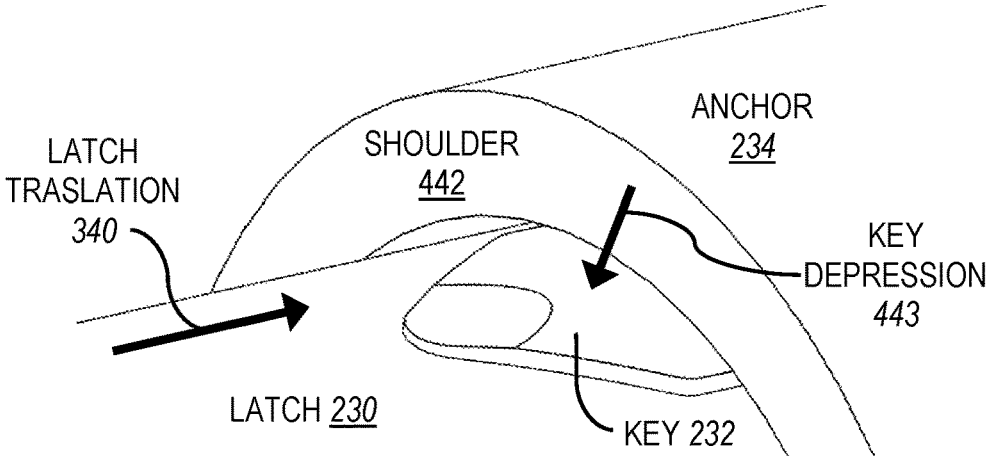
FIG. 4C is a diagram of a key jammed into an anchor.

FIG. 4A is a diagram of a latch and anchor when a key is moving towards a shoulder. FIG. 4B is a diagram of a latch and anchor improperly engaging. FIG. 4C is a diagram of a key jammed into an anchor. In the example of FIGS. 4A-C, a scenario is shown where latch 230 improperly engages anchor 234 causing latch 230 and/or anchor 234 to become jammed, stuck, and/or broken.

Shoulder 442 is a component of anchor 234 which is configured to provide a mechanical stop for latch 230 (e.g., preventing further latch translation 340). In any embodiment, shoulder 442 may be constructed to not cause rotation of latch 230 (e.g., be a "flat" surface that does not bias key 232 in either direction, unlike guide 344). Accordingly, shoulder 442 may be used to reduce the magnitude of possible latch rotation 342. That is, if large latch torque 345 is not acceptable on latch 230, a shoulder may be constructed on anchor 234 to prevent latch rotation 342 when key 232 is aligned to contact shoulder 442. Thus, latch rotation 342 is only permitted inside of a window of angles where key 232 would contact guide 344. In any embodiment, shoulder 442 may provide feedback (e.g., information) to an operator (e.g., a human, information handling system 130). That is, key 232 contacting shoulder 442 may provide information about depth and/or angle of the latch 230.

Key depression 443 is the linear motion of key 232 inwards (i.e., towards the axis of rotation) on latch 230. In any embodiment, key 232 may be constructed to (at least partially) collapse inward to latch 230. Such movement may be designed to allow key 232 to traverse smaller diameter volumes of anchor 234 and/or provide better engagement and/or interlocking with anchor 234. In any embodiment, key 232 may be spring loaded, hydraulically controlled, and/or otherwise constructed to allow for inward (and outward) linear motion.

In an ideal scenario, key 232 contacts shoulder 442 and is not biased towards rotating in either direction. Further, in an ideal scenario, latch 230 cannot undergo additional latch translation 340 as the contact between key 232 and shoulder 442 prevents further movement. However, as shown in the example of FIGS. 4A-C, latch translation 340 causes key 232 to force movement into the internal diameter of anchor 234 under shoulder 442 (i.e., towards the axis of rotation). Specifically, latch 230 may buckle away from the axis of rotation when (i) large forces placed on latch 230 (e.g., those to cause latch translation 340) and (ii) the forces counteracting latch translation 340 are applied on only one side of latch 230 parallel to the axis of rotation (the counter force between key 232 and shoulder 442). Such a lateral buckling motion may provide sufficient volume for the leading edge of key 232 to begin to slip under shoulder 442.

In any embodiment, anchor 234 and latch 230 may not be designed to accept key 232 under shoulder 442. Accordingly, such improper engagement may cause the latch 230 to become stuck, jammed, and/or broken within borehole 116. Although the example shown in FIGS. 4A-C show key 232 capable of key depression 443, such capabilities may not be required for improper engagement to occur. That is, even with a rigidly affixed key 232, excessive latch translation 340 may cause latch 230 to pivot away from the axis of rotation, thereby providing a larger opening for key 232 to slip under shoulder 442.

FIGS. 5A-C

Figure 5A:
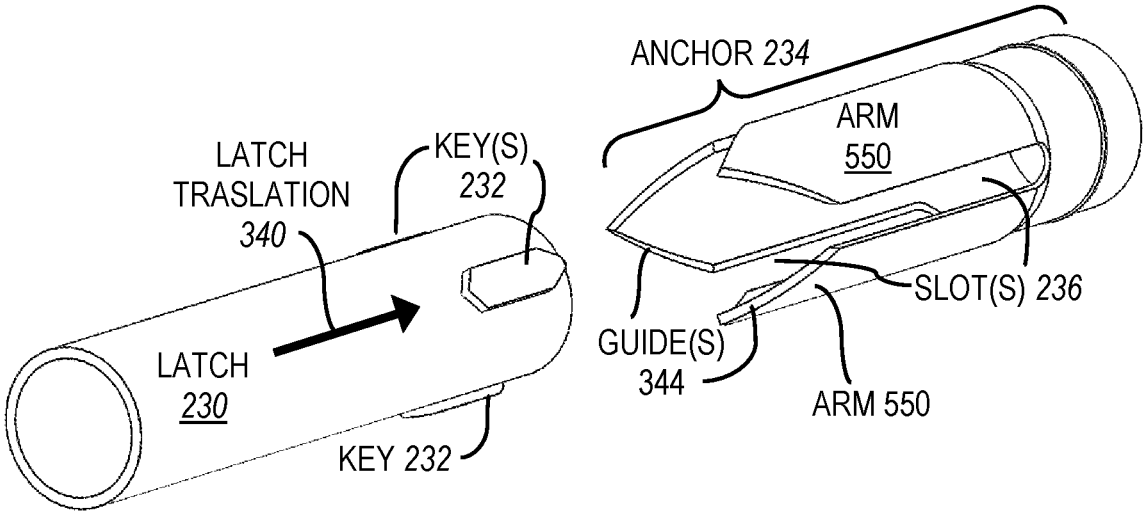
FIG. 5A is a diagram of a latch and anchor when the latch is approaching the anchor.
Figure 5B:
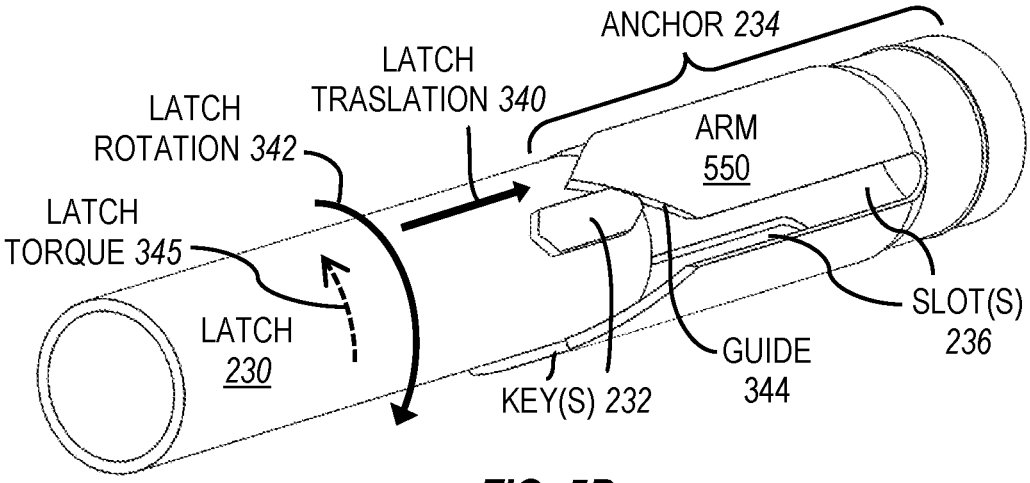
FIG. 5B is a diagram of a latch and anchor when the keys are in sliding contact with the guides.
Figure 5C:
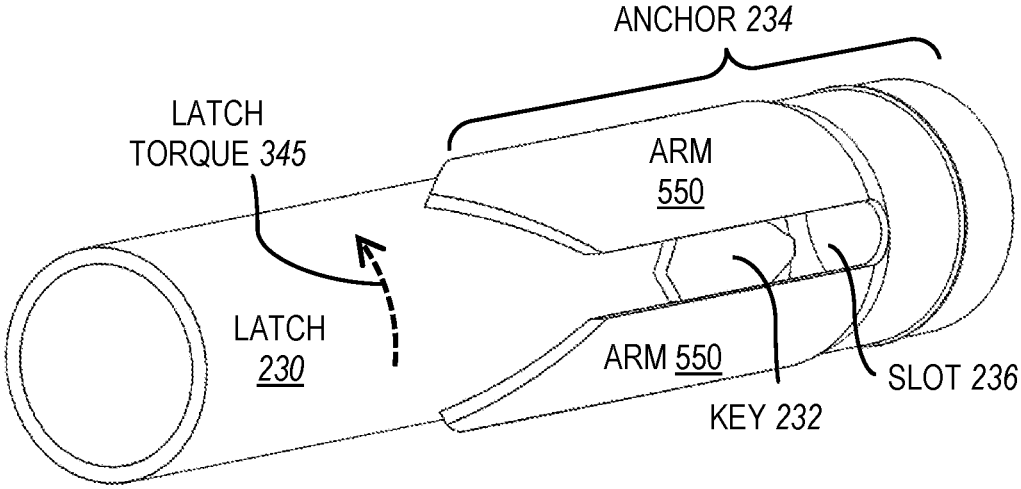
FIG. 5C is a diagram of a latch and anchor when the keys are sliding down the slots of the anchor.

FIG. 5A is a diagram of a latch and anchor when the latch is approaching the anchor. FIG. 5B is a diagram of a latch and anchor when the keys are in sliding contact with the guides. FIG. 5C is a diagram of a latch and anchor when the keys are sliding down the slots of the anchor. In the example of FIGS. 5A-C, a scenario is shown where latch 230 includes three keys 232 and anchor 234 includes three slots 236.

Arm 550 is a component of anchor 234 which is formed by the presence of two adjacent slots 236. In any embodiment, two slots 236 along the length of anchor 234 form a protruding member (arm 550) which extends uphole (e.g., towards latch 230). Consequently, guide(s) 344 and/or shoulder(s) 442 may exist on the leading edge of arm 550, where key(s) 232 may initially contact anchor 234 (e.g., due to latch translation 340).

As shown in the example of FIGS. 5A-C, anchor 234 includes three slots 236 for three corresponding key(s) 232. Accordingly, the guide(s) 344 may only cause latch rotation 342 of ±60°. Consequently, latch torque 345 is potentially reduced as latch 230 is not caused to rotate more than 60° (in either direction).

A person of ordinary skill in the art, provided the benefit of this detailed description, would appreciate that the quantity of keys 232 does not need to match the quantity of slots 236. In any embodiment, a single key 232 (without any additional keys 232) may be sufficient for the operation of the disclosed system. As a non-limiting example, latch 230 (shown in FIGS. 5A-C) may be modified to include only one key 232, and would continue to operate, as described, with anchor 234 having three slots 236.

A person of ordinary skill in the art, provided the benefit of this detailed description, would appreciate that the number of slots 236 may be increased to further reduce latch rotation 342. That is, as a non-limiting example, an anchor 234 with four slots 236 may cause latch rotation 342 up to ±45°. As a non-limiting example, an anchor 234 with five slots 236 may cause latch rotation 342 up to ±36°.

FIGS. 6A-D

Figure 6A:
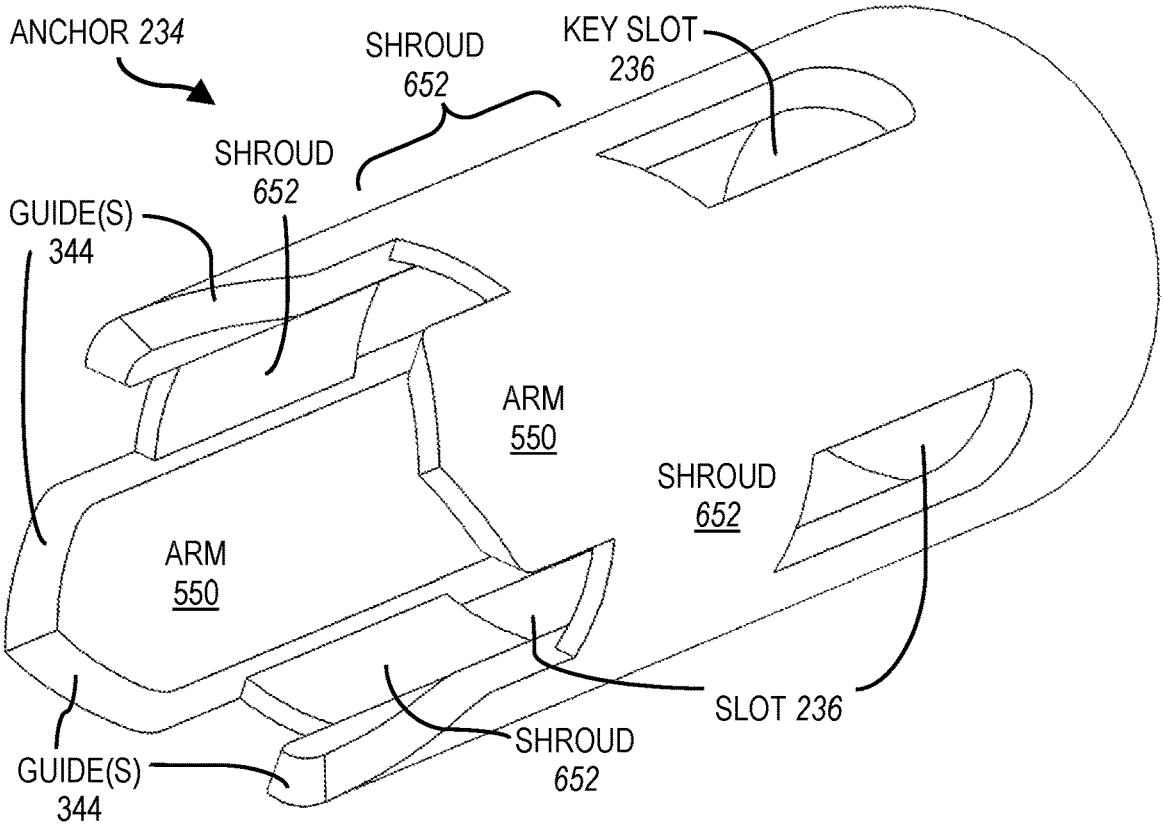
FIG. 6A is a diagram of an example anchor with a shroud.
Figure 6B:
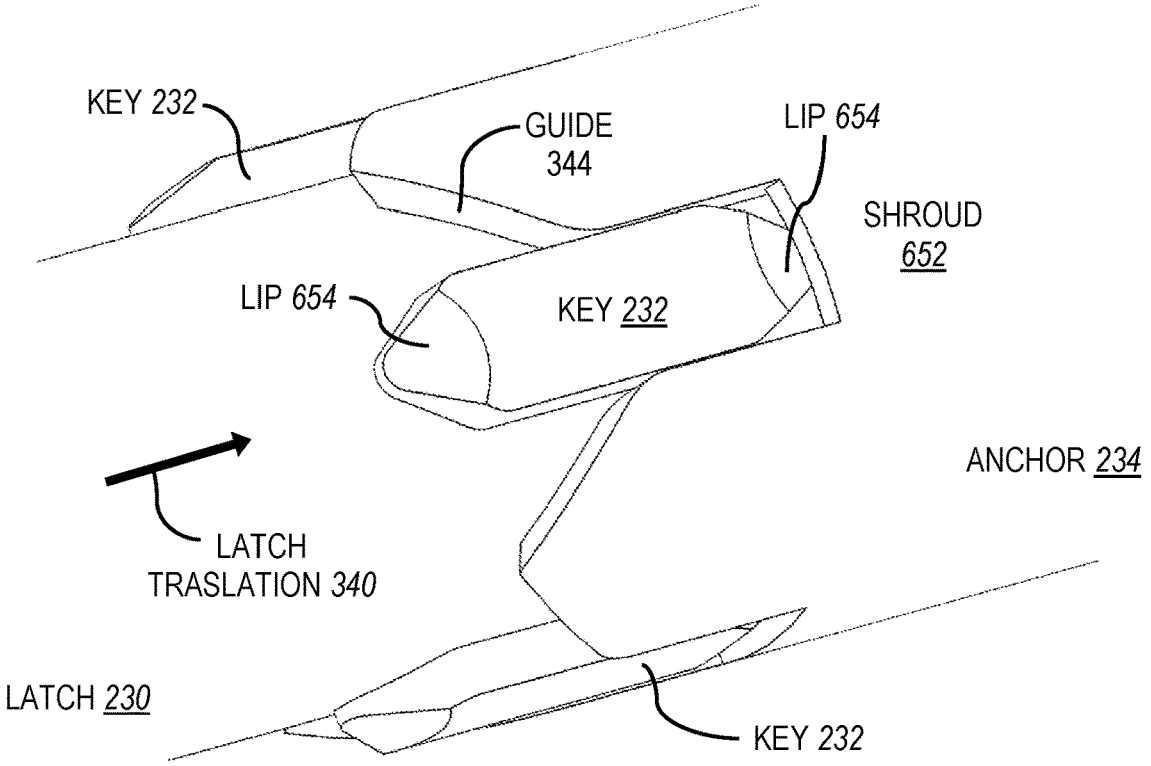
FIG. 6B is a diagram of an example latch approaching a shroud of an anchor.
Figure 6C:
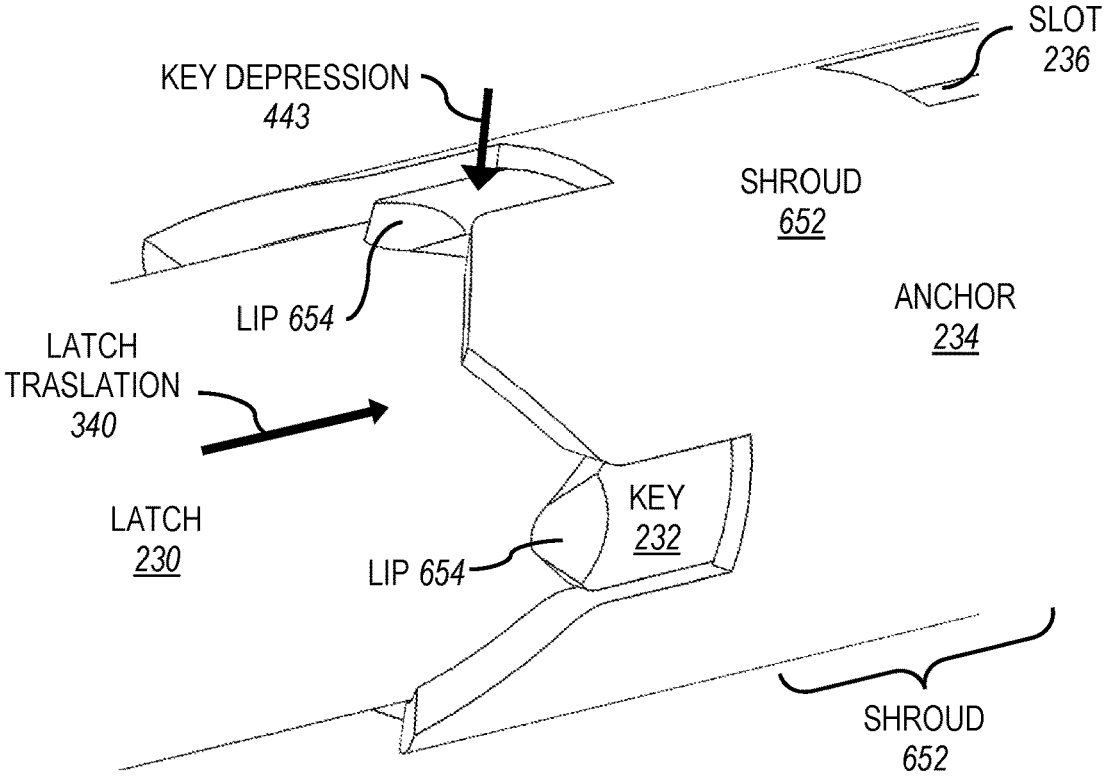
FIG. 6C is a diagram of keys sliding under the shroud of an anchor.
Figure 6D:
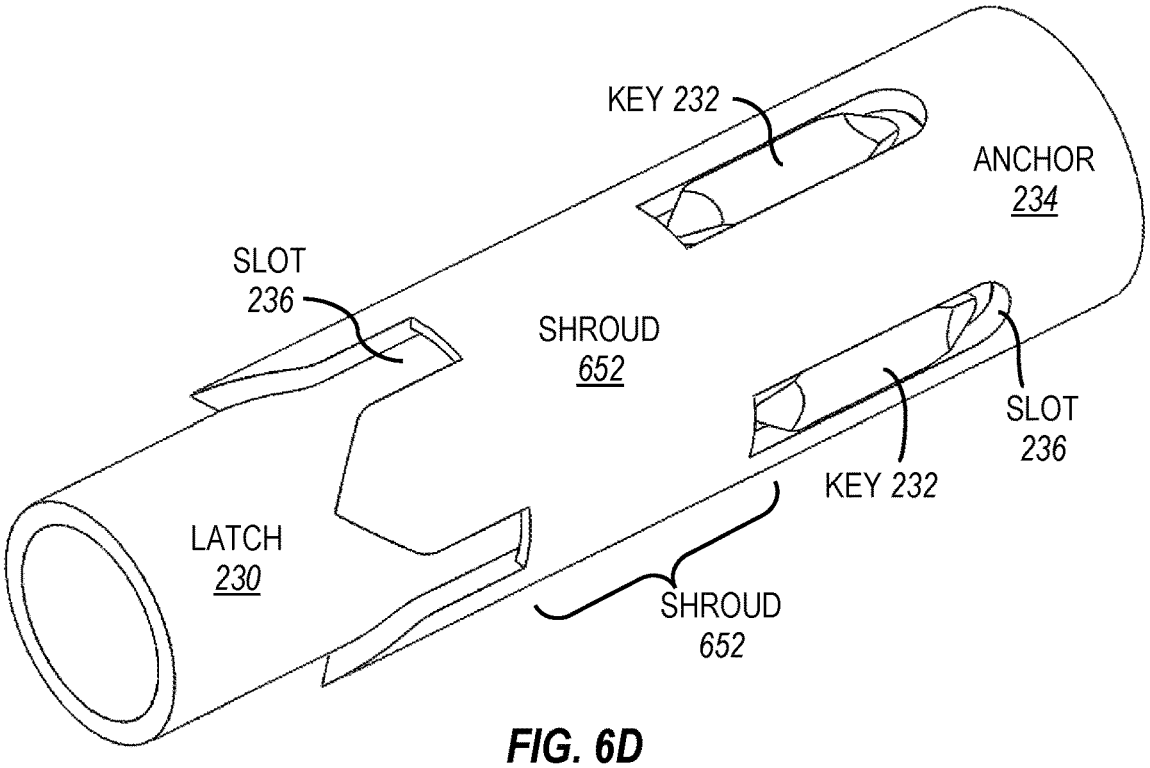
FIG. 6D is a diagram of keys in slots after traversing a shroud.

FIG. 6A is a diagram of an example anchor with a shroud. FIG. 6B is a diagram of an example latch approaching a shroud of an anchor. FIG. 6C is a diagram of keys sliding under the shroud of an anchor. FIG. 6D is a diagram of keys in slots after traversing a shroud. In the example of FIGS. 6A-D, a scenario is shown where anchor 234 includes four slots 236 with shroud 652 and latch 230 with keys 232 constructed to traverse shroud 652.

Shroud 652 is component of anchor 234 which provides structural support to arms 550. In any embodiment, as the quantity of slots 236 is increased, the circumferential width of corresponding arms 550 is decreased. Further, axially longer slots 236 cause correspondingly longer arms 550. Consequently, arms 550, particularly with larger length-to-width ratios, may not have sufficient structure to withstand the torsional forces exerted by latch 230. Accordingly, shroud 652 may be constructed as part of anchor 234 to provide additional rigidity, strength, and/or structure to arms 550. In any embodiment, the internal diameter of shroud 652 may be greater than the internal diameter of arms 550 to allow for keys 232 to traverse shroud 652 (thereby allowing for further latch translation 340). In any embodiment, shroud 652 may be constructed by (i) not fully cutting out slots 236 (i.e., leaving a band of material around anchor 234), (ii) placing a band around anchor 234, and/or (iii) any combination thereof.

Lip 654 is a component of key 232 which is used to guide key 232 under a structure and cause key depression 443. As shroud 652 may obstruct the movement of keys 232 further into anchor 234, lip 654 provides means for key 232 to slip under shroud 652 and begin key depression 443. In any embodiment, lip 654 may take the form of a tapered (e.g., chamfered) edge of key 232. Thus, when undergoing latch translation 340, lip 654 initially contacts an inner edge of shroud 652 and continues to slide under shroud 652 as key 232 undergoes further key depression 443. Once key 232 is pressed sufficiently inward, the main body of key 232 may proceed to traverse under shroud 652. Key 232 may include two lips 654, at each end, to allow for removal of latch 230 from anchor 234. Key 232 may automatically expand (undoing key depression 443) once any radial force applied to key 232 is removed (e.g., an open slot 236 downhole from shroud 652).

In any embodiment, lip 654 may taper at an angle such that predetermined (i.e., known) forces must be exerted for key 232 to undergo key depression 443 at different shroud(s) 652 (e.g., on different anchors 234 and/or different portions of a single anchor 234). That is, as a non-limiting example, anchor 234 may include a first shroud 652 with a sufficiently large inner diameter to allow the tapered edge of lip 654 to slide under the first shroud 652 with relatively little force. Additionally, further downhole, that same anchor 234 may include a second shroud 652 with a smaller inner diameter where more force is required for lips 654 to proceed under the second shroud 652. Accordingly, by precisely designing the tapered angle of lip(s) 654 and the inner diameters of shroud 652, feedback to a user may be provided (at the surface) in the form of controlling and monitoring the applied force. That is, when inserting drillstring 114 further downhole, the applied force can be used to confirm the axial position and/or orientation of latch 230. If a known applied force is surpassed, one or more key(s) 232 are likely engaging one or more shoulder(s) 442. However, if the known force is applied and movement of drillstring 114 proceeds (as expected), then a user is more confident in the axial position and/or orientation of latch 230 (and drillstring 114 overall).

In any embodiment, latch 230, key(s) 232, and/or anchor 234 may include one or more component(s) (e.g., a locking device) to prevent linear (and/or rotational) movement of latch 230, when latch 230 is engaged with anchor 234, until a threshold force (and/or torque) is applied to release latch 230 from anchor 234. As a non-limiting example, after latch 230 is fully inserted into anchor 234, latch 230 may be removed by applying a pulling force to latch 230. However, for key(s) 232 to recede past shroud 652, lip(s) 654 on the uphole-side of key(s) 232 must engage shroud 652 and cause key depression 443. Thus, some threshold force is required to remove latch 230, depending on the geometry of lip(s) 654 on the uphole-side of key(s) 232 and the inner diameter of shroud 652. Further, in any embodiment, rotational alignment may be overcome by applying sufficient torque to latch 230 to disengage latch 230 from anchor 234. As a non-limiting example, key(s) 232 may have grooves (not shown) and/or lips (not shown) on lateral sides that allow key(s) 232 rotates within anchor 234 (e.g., in one or more complementary grooves, channels, or slots). Additional examples of a locking device that may be used to detachably affix latch 230 to anchor 234 include a collet, a shear ring, a snap ring, and a shear screw.

FIGS. 7A-B

Figure 7A:
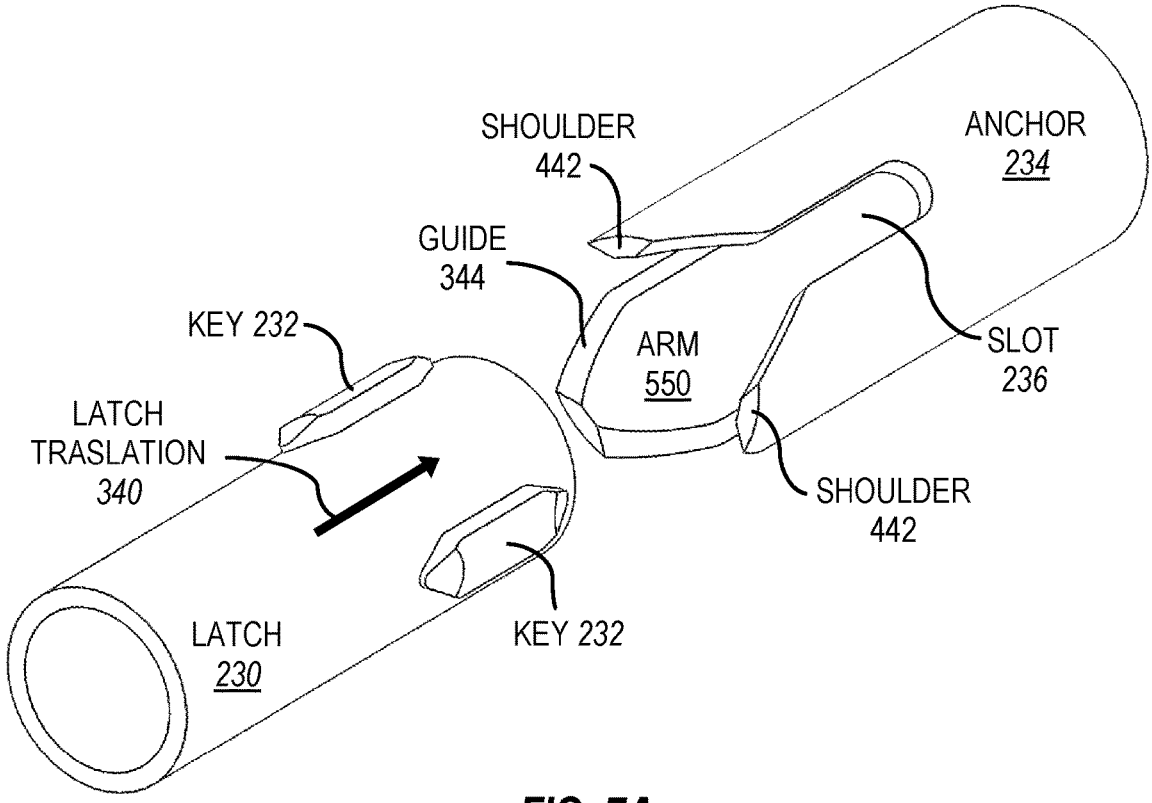
FIG. 7A is a diagram of an example latch approaching an anchor with multiple arms and shoulders.
Figure 7B:
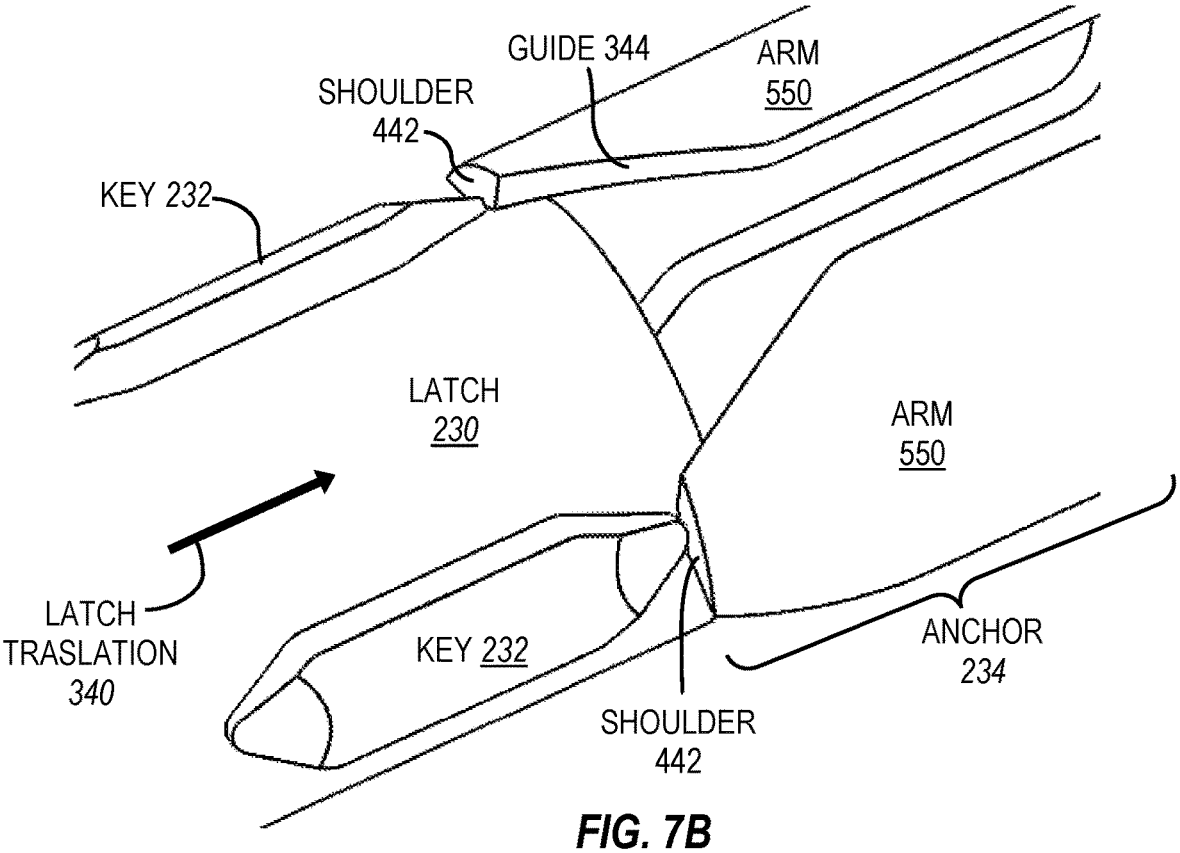
FIG. 7B is a diagram of keys contacting shoulders.

FIG. 7A is a diagram of an example latch approaching an anchor with multiple arms and shoulders. FIG. 7B is a diagram of keys contacting shoulders. In the example of FIGS. 7A-B, a scenario is shown where latch 230 includes three keys 232 and anchor 234 includes three slots 236 and three arms 550. Further, each arm 550 includes a shoulder 442.

In FIG. 7A, latch 230 is undergoing latch translation 340 and approaching anchor 234. In FIG. 7B, it is shown that, due to the orientation of latch 230, each key 232 contacts each shoulder 442, respectively. Consequently, latch translation 340 cannot proceed. However, unlike the example of FIGS. 4A-C, latch 230 cannot improperly engage anchor 234 (e.g., slide under shoulders 442, jam, break, etc.). Instead, as the contact between each key 232 and shoulder 442 provides (relatively) equal counter forces, the combined force (counteracting latch translation) is centered within latch 230. Thus, latch 230 is not biased to buckle away from the axis of rotation (unlike the example of FIGS. 4A-C, when a counter force is applied on only one side, parallel to the axis of rotation). Further, even if latch 230 were to experience lateral movements, there is not a sufficient volume for latch 230 to misalign with anchor 234. That is, any one key 232 could not traverse under shoulder 442 as the movement away from the axis of rotation (in any direction) would cause greater contact between the opposing keys 232 and shoulders 442.

In the example of FIGS. 7A-B, it may be required to cause latch rotation 342 through other means (e.g., by control at the surface). Then, after latch 230 is (at least partially) rotated, reapproach to anchor 234 may be attempted via latch translation 340, with the intent for keys 232 to contact guides 344 (or directly align with slots 236). If keys 232 again contact shoulder 442, additional latch rotation 342 may be repeated until latch 230 is rotated to some acceptable angle of alignment.

FIG. 8

Figure 8:
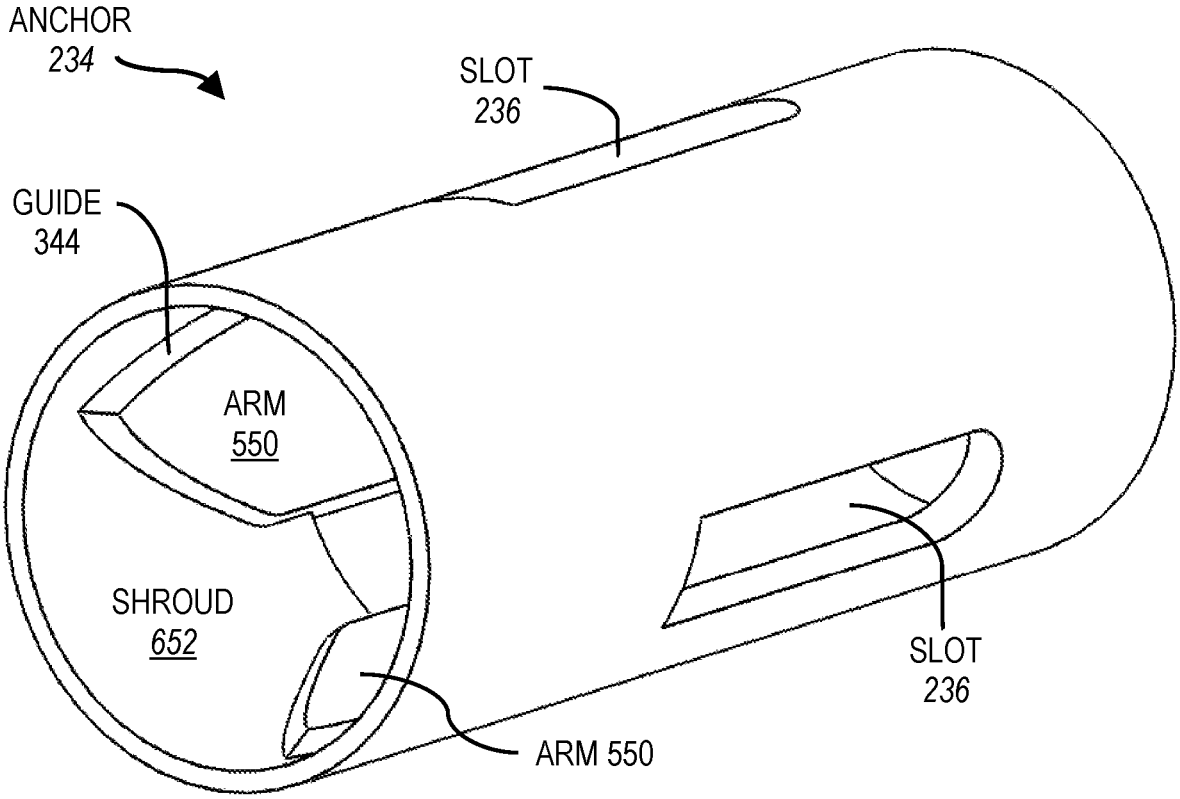
FIG. 8 is a diagram of an example anchor with a shroud around the tips of the arms.

FIG. 8 is a diagram of an example anchor with a shroud around the tips of the arms. In any embodiment, anchor 234 may include a shroud 652 disposed around (and beyond) the axial distal ends of arms 550. As shown in the example of FIG. 8, shroud 652 is the forward-most (uphole) portion of anchor 234. Accordingly, key(s) 232 of latch 230 (not shown) approaching anchor 234 would first contact shroud 652 (e.g., via lip(s) 654). In any embodiment, in addition to the structural support provided, shroud 652 placed around the distal end of anchor 234 may provide additional protection to the tips and/or edges of arms 550, guides 344, and/or anchor 234 generally.

FIG. 9A-B

Figure 9A:
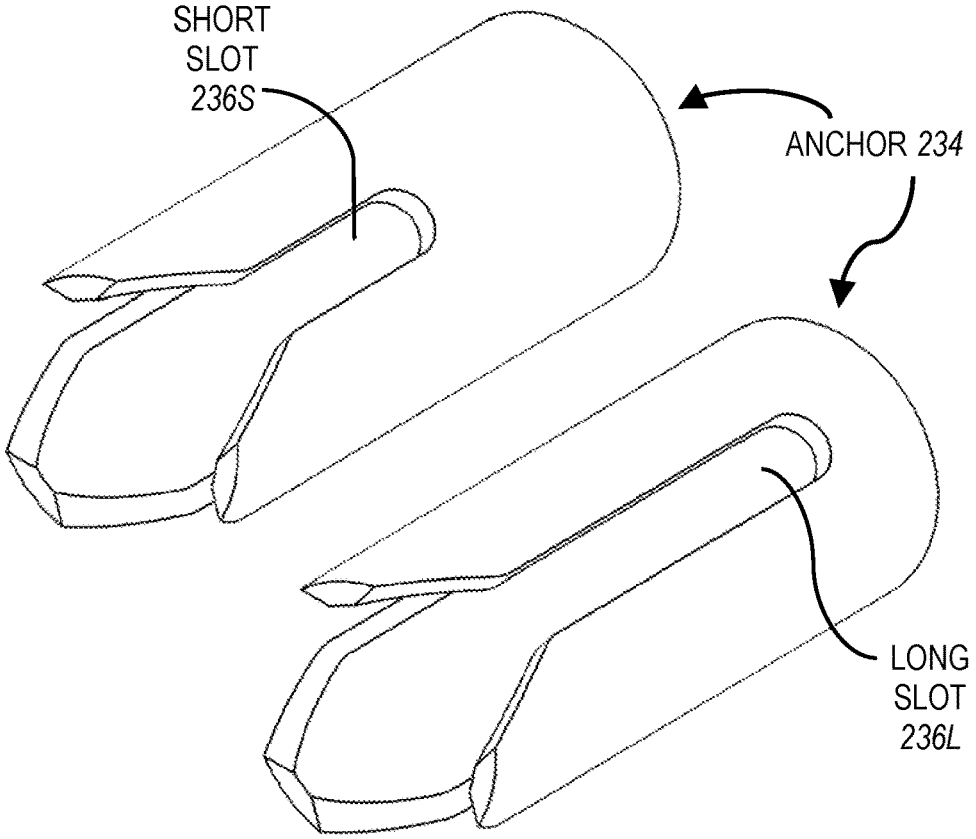
FIG. 9A is a diagram of an example anchor with slots of varying depths.

FIG. 9A is a diagram of an example anchor with slots of varying depths. As shown in the example of FIG. 9A, anchor 234 includes (at least) two slots 236. Short slot 236S extends partially down the length of anchor 234 (e.g., about halfway) whereas long slot 236L extends most of the length of anchor 234 (e.g., over three-quarters).

Figure 9B:
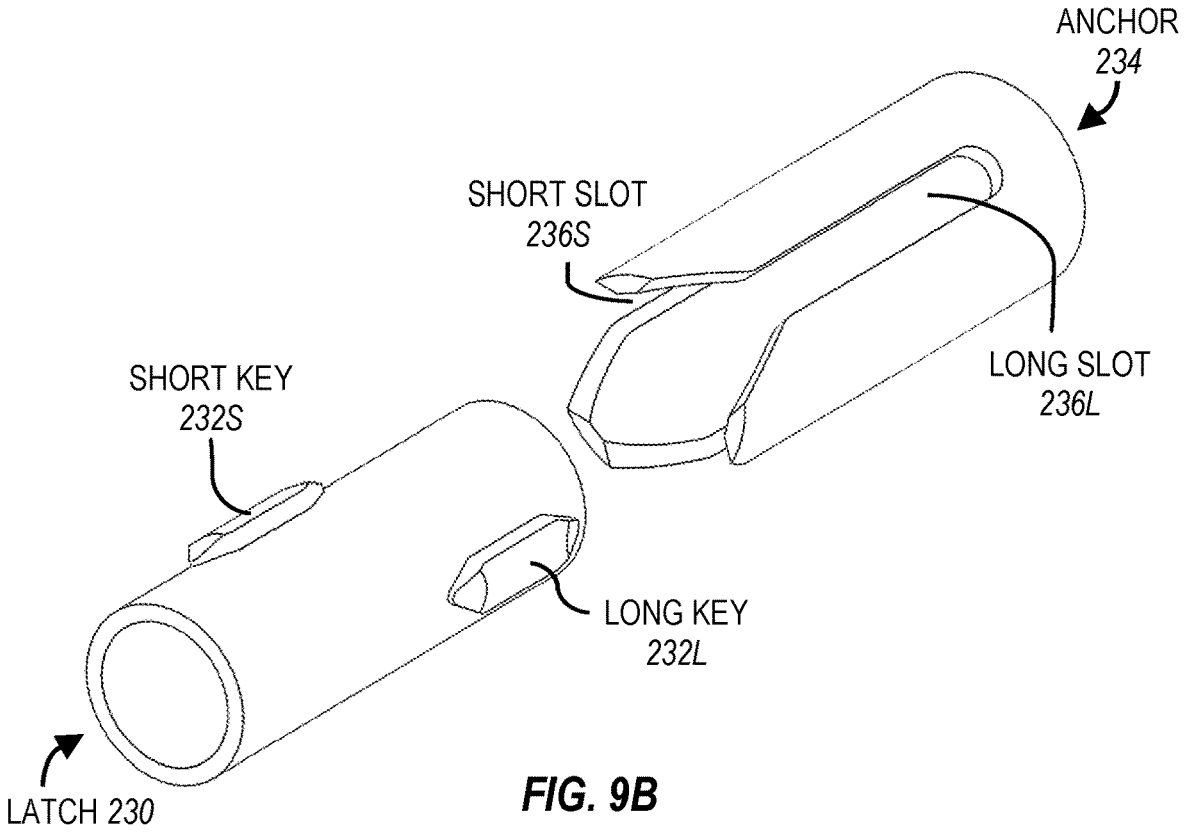
FIG. 9B is a diagram of a latch with varying key depths and an anchor with varying slot depths.

FIG. 9B is a diagram of a latch with varying key depths and an anchor with varying slot depths. As shown in the example of FIG. 9B, anchor 234 (the same anchor 234 shown in FIG. 9A) is axially aligned with latch 230. Latch 230 includes short key 232S and long key 232L. Long key 232L is disposed further downhole on the body of latch 230 than short key 232S. Accordingly, for proper engagement of latch 230 with anchor 234, long key 232L must align with long slot 236L and short key 232S must align with short slot 236S.

Conversely, in any embodiment, if long key 232L aligned and translates into short slot 236S, latch translation 340 will be preemptively stopped as long key 232L will engage the bottom of short slot 236S. Such a configured may be an undesirable orientation of latch 230 and therefore require (at least partially) withdrawing latch 230, rotating latch 230, and reinserting latch 230 until each key 232 is aligned with their respective slot 236.

FIG. 10

Figure 10:
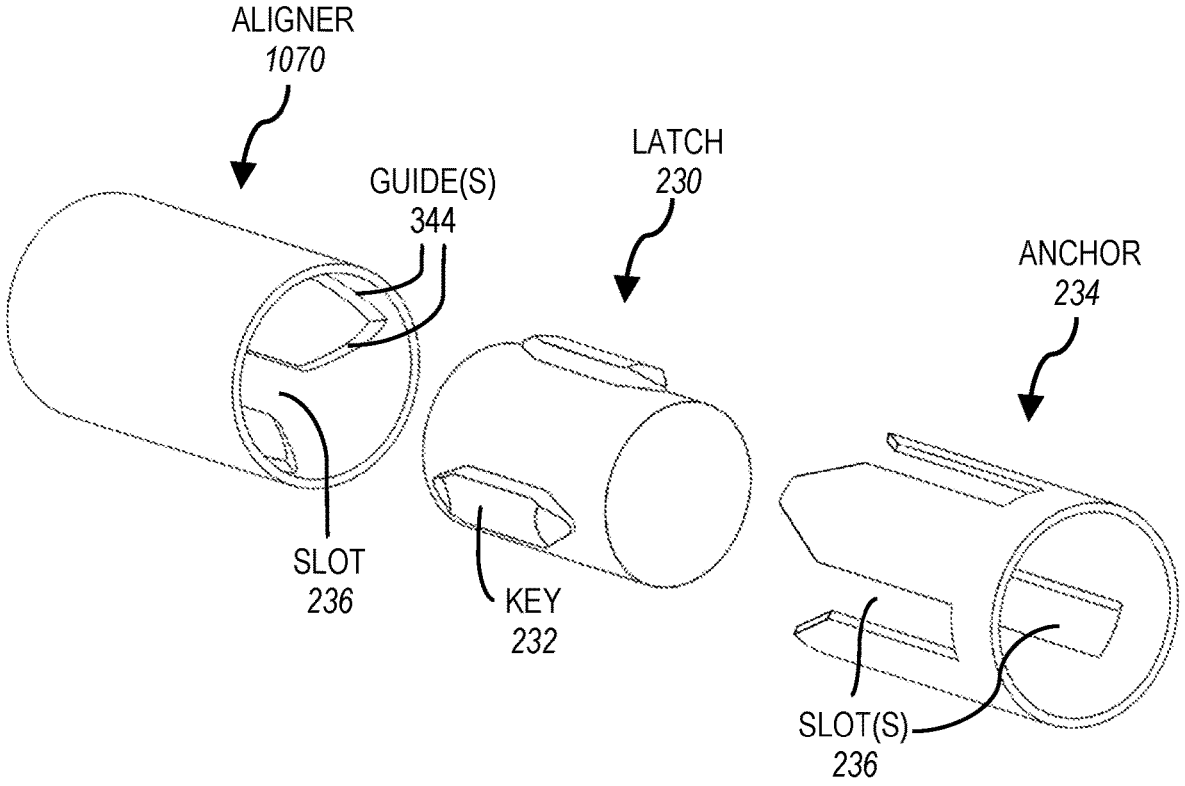
FIG. 10 is a diagram of an example system with an aligner disposed uphole from an anchor.

FIG. 10 is a diagram of an example system with an aligner disposed uphole from an anchor. As shown in the example of FIG. 10, an additional component, aligner 1070, may be disposed uphole from anchor 234. In such a system, latch 230 may traverse through aligner 1070 prior to engagement with anchor 234 (when undergoing latch translation 340 from uphole to downhole). Aligner 1070 may include slot(s) 236 and guide(s) 344 to orient latch 230. Unlike anchor 234, aligner 1070 does not include an end to slot(s) 236, therefore allowing latch 230 to pass completely therethrough. Aligner 1070 may be used for (at least partially) aligning latch 230 prior to approaching and engaging anchor 234.

Solutions and Improvements

The methods and systems described above are an improvement over the current technology as the methods and systems described herein provide a latch and anchor mechanism that requires less rotation of the latch (and/or any tools attached thereto). Further, the risk of improper engagement between the latch and anchor may be eliminated as multiple keys prevent undesired movement of the latch.

Specifically, in any embodiment, a latch and anchor system shown herein may include multiple keys and slots to provide multiple proper angles of engagement. As a non-limiting example, with four keys and four slots, a latch would only need to rotate ±45° (or nearly 90°, depending on the configuration). Thus, only one-fourth of the rotation may be required, thereby reducing the torsional stresses in the latch (and/or any tools attached thereto).

Such a system is an improvement over conventional latch and anchor mechanisms, as conventional systems may only include a single key on a latch with only a single slot on the anchor. Consequently, a latch may have to rotate ±180° (or nearly 360°, depending on the configuration) for the key and slot to align. In turn, such large rotations of the latch cause undesirable torsional stresses to be statically loaded on the latch (and/or any tools additionally attached to the latch).

Further, in system where there is only a single key (or a single initial point of contact between the latch and anchor) there is a possibility that the latch and anchor may improperly engage (e.g., a key may slide into an internal diameter of the anchor at an undesirable location) causing a jam and/or breakage of the latch, anchor, and/or other tools.

Statements

The systems and methods may comprise any of the various features disclosed herein, comprising one or more of the following statements.

Statement 1: A system comprising: an anchor comprising a plurality of slots; and a latch comprising a key, wherein while the latch undergoes latch translation, the key is adapted to translate into a slot of the plurality of slots.

Statement 2: The system of statement 1, wherein the anchor further comprises a plurality of guides, and wherein while the latch undergoes the latch translation, the key makes contact with a guide of the plurality of guides.

Statement 3: The system of statement 2, wherein the latch undergoes latch rotation, and wherein the latch rotation is caused by: the latch translation; and the contact between the key and the guide.

Statement 4: The system of statements 1-3, wherein the anchor further comprises a plurality of arms formed by the plurality of slots.

Statement 5: The system of statement 4, wherein the anchor further comprises a shroud, wherein the shroud circumferentially surrounds the plurality of arms.

Statement 6: The system of statement 5, wherein: the key comprises a lip adapted to allow the key to traverse past the shroud while the key is traversing the shroud, the key undergoes key depression.

Statement 7: The system of statement 6, wherein after traversing the shroud, the key is not undergoing key depression.

Statement 8: The system of statements 4-7, wherein: the plurality of arms comprises a plurality of shoulders, respectively, and while the latch undergoes the latch translation, the key is adapted to contact a shoulder of the plurality of shoulders.

Statement 9: A system comprising: an anchor comprising a first slot and a second slot; and a latch comprising a first key and a second key, wherein while the latch undergoes latch translation, the first key and the second key are adapted to translate into the first slot and the second slot, respectively.

Statement 10: The system of statement 9, wherein the anchor further comprises a first guide and a second guide, and wherein while the latch undergoes the latch translation, the first key and the second key make contact with the first guide and the second guide, respectively.

Statement 11: The system of statement 10, wherein the latch undergoes latch rotation, and wherein the latch rotation is caused by: the latch translation; the contact between the first key and the first guide; and the contact between the second key and the second guide.

Statement 12: The system of statement 11, wherein the latch translation stops when the first key engages a bottom of the first slot and the second key engages a bottom of the second slot.

Statement 13: The system of statement 12, wherein: the latch rotation causes the latch to be at a known orientation, and the first key engaging with the bottom of the first slot and the second key engaging with the bottom of the second slot, causes the latch to be at a known axial location.

Statement 14: The system of statements 9-13, wherein the anchor further comprises a first arm and a second arm formed by the first slot and the second slot.

Statement 15: The system of statement 14, wherein the anchor further comprises a shroud, wherein the shroud circumferentially surrounds the first arm and the second arm.

Statement 16: The system of statement 15, wherein the first key comprises a first lip adapted to allow the first key to traverse past the shroud, and wherein the second key comprises a second lip adapted to allow the second key to traverse past the shroud.

Statement 17: The system of statement 16, wherein while the first key is traversing the shroud, the first key and the second key undergo key depression.

Statement 18: The system of statement 17, wherein after traversing the shroud, the first key and the second key are not undergoing key depression.

Statement 19: The system of statements 14-18, wherein the first arm comprises a first shoulder, and wherein the second arm comprises a second shoulder.

Statement 20: The system of statement 19, wherein while the latch undergoes the latch translation, the first key and the second key are adapted to contact the first shoulder and the second shoulder, respectively.

General Notes

As it is impracticable to disclose every conceivable embodiment of the technology described herein, the figures, examples, and description provided herein disclose only a limited number of potential embodiments. A person of ordinary skill in the art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to people of ordinary skill in the art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment-which may be implemented in addition to, in conjunction with, or in place of an embodiment of a similarly-named component described for any other figure.

Lexicographical Notes

As used herein, adjective ordinal numbers (e.g., first, second, third, etc.) are used to distinguish between elements and do not create any particular ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, the word "data" may be used as an "uncountable" singular noun—not as the plural form of the singular noun "datum". Accordingly, throughout the application, "data" is generally paired with a singular verb (e.g., "the data is modified"). However, "data" is not redefined to mean a single bit of digital information. Rather, as used herein, "data" means any one or more bit(s) of digital information that are grouped together (physically or logically). Further, "data" may be used as a plural noun if context provides the existence of multiple "data" (e.g., "the two data are combined").

As used herein, the term "operative connection" (or "operatively connected") means the direct or indirect connection between devices that allows for interaction in some way (e.g., via the exchange of information). For example, the phrase 'operatively connected' may refer to a direct connection (e.g., a direct wired or wireless connection between devices) or an indirect connection (e.g., multiple wired and/or wireless connections between any number of other devices connecting the operatively connected devices).

As used herein, indefinite articles "a" and "an" mean "one or more". That is, the explicit recitation of "an" element does not preclude the existence of a second element, a third element, etc. Further, definite articles (e.g., "the", "said") mean "any one of" (the "one or more" elements) when referring to previously introduced element(s). As an example, there may exist "a processor", where such a recitation does not preclude the existence of any number of other processors. Further, "the processor receives data, and the processor processes data" means "any one of the one or more processors receives data" and "any one of the one or more processors processes data". It is not required that the same processor both (i) receive data and (ii) process data. Rather, each of the steps ("receive" and "process") may be performed by different processors.

As used herein, "machine" means any collection of components assembled to form a tool, structure, or other apparatus. A collection of components may be grouped together and referred to as a single 'machine' based on the functionality of the machine enabled by the combination of the components. As a non-limiting example, a "car engine" is a machine assembled from the components of an engine block, one or more piston(s), a camshaft, etc. that, when combined, function to convert chemical energy into mechanical energy. Further, a machine may be constructed using one or more other machine(s). As a non-limiting example, an automobile may be an assembly of an engine, a drivetrain, and a steering system—each an independent machine—but assembled to form a larger 'automobile' machine which functions to provide transportation.

What is claimed is:

1. A system disposed in a borehole, comprising:
an anchor rotationally fixed to the borehole, comprising:
a plurality of slots;
a plurality of arms formed by the plurality of slots; and
a shroud circumferentially surrounding the plurality of arms; and
a latch comprising:
a key,
wherein while the latch undergoes latch translation, the key is adapted to translate into a slot of the plurality of slots.

2. The system of claim 1, wherein:
the anchor further comprises a plurality of guides, and
while the latch undergoes the latch translation, the key makes contact with a guide of the plurality of guides.

3. The system of claim 2, wherein the latch undergoes latch rotation, and wherein the latch rotation is caused by:
the latch translation; and
the contact between the key and the guide.

4. The system of claim 1, wherein:
the key comprises a lip adapted to allow the key to traverse past the shroud, and
while the key is traversing the shroud, the key undergoes key depression.

5. The system of claim 4, wherein after traversing the shroud, the key is not undergoing the key depression.

6. The system of claim 1, wherein:
the plurality of arms comprises a plurality of shoulders, respectively, and
while the latch undergoes the latch translation, the key is adapted to contact a shoulder of the plurality of shoulders.

7. The system of claim 1, wherein the anchor is longitudinally fixed to the borehole.

8. A system disposed in a borehole, comprising:
an anchor rotationally fixed to the borehole, comprising:
a first slot;
a second slot;
a first arm and a second arm formed by the first slot and the second slot; and
a shroud circumferentially surrounding the first arm and the second arm; and
a latch comprising:
a first key; and
a second key,
wherein while the latch undergoes latch translation, the first key and the second key are adapted to translate into the first slot and the second slot, respectively.

9. The system of claim 8, wherein:
the anchor further comprises a first guide and a second guide, and
while the latch undergoes the latch translation, the first key and the second key make contact with the first guide and the second guide, respectively.

10. The system of claim 9, wherein the latch undergoes latch rotation, and wherein the latch rotation is caused by:
the latch translation;
the contact between the first key and the first guide; and
the contact between the second key and the second guide.

11. The system of claim 10, wherein:
the latch rotation causes the latch to be at a known orientation,
the latch translation stops when the first key engages a first bottom of the first slot and the second key engages a second bottom of the second slot, and the first key engaging with the first bottom of the first slot and the second key engaging with the second bottom of the second slot, causes the latch to be at a known axial location.

12. The system of claim 8, wherein:

the first key comprises a first lip adapted to allow the first key to traverse past the shroud, and the second key comprises a second lip adapted to allow the second key to traverse past the shroud.

13. The system of claim 12, wherein while the first key is traversing the shroud, the first key and the second key undergo key depression.

14. The system of claim 13, wherein after traversing the shroud, the first key and the second key are not undergoing the key depression.

15. The system of claim 8, wherein:

the first arm comprises a first shoulder, the second arm comprises a second shoulder, and while the latch undergoes the latch translation, the first key and the second key are adapted to contact the first shoulder and the second shoulder, respectively.

16. The system of claim 8, wherein the first slot has a first depth and the second slot has a second depth, wherein the first depth is different from the second depth.

17. A method for guided orientation of a latch into an anchor, comprising:

disposing the latch in a borehole, wherein the latch comprises:

a key;

rotating the latch by sliding the key along a guide of the anchor, wherein the anchor is rotationally fixed to the borehole, and wherein the anchor comprises:

a plurality of slots;

a plurality of arms formed by the plurality of slots; and a shroud circumferentially surrounding the plurality of arms;

translating the latch into the anchor; and while translating the latch:

sliding the key into a slot of the plurality of slots.

18. The method of claim 17, wherein the key comprises a lip, and the method further comprises:

monitoring an applied force at a surface location, wherein a change in the applied force indicates an interaction between the lip and the shroud, thereby confirming an axial position of the latch.

19. The method of claim 17, further comprising:

depressing the key while traversing the shroud.

20. The method of claim 19, wherein after traversing the shroud, the key ceases to undergo key depression.

* * * * *